US010022644B1

(12) United States Patent
Wakim et al.

(10) Patent No.: US 10,022,644 B1
(45) Date of Patent: Jul. 17, 2018

(54) BUILDING BRICK BASE ASSEMBLY

(71) Applicants: Marc-Henry Wakim, Goodview, MN (US); Brian Semling, Fountain City, WI (US)

(72) Inventors: Marc-Henry Wakim, Goodview, MN (US); Brian Semling, Fountain City, WI (US)

( * ) Notice: Subject to any disclaimer, the term of this patent is extended or adjusted under 35 U.S.C. 154(b) by 0 days.

(21) Appl. No.: 15/453,415

(22) Filed: Mar. 8, 2017

(51) Int. Cl.
*A63H 33/04* (2006.01)
*A63H 33/08* (2006.01)
*A63G 9/00* (2006.01)

(52) U.S. Cl.
CPC ..... *A63H 33/044* (2013.01); *A63H 33/086* (2013.01)

(58) Field of Classification Search
CPC ..... A63H 33/04; A63H 33/08; A63H 33/044; A63H 33/062; A63H 33/084; A63H 33/086; A63H 33/088; A63H 33/101; A63G 9/00; A63G 9/12; A63G 9/124
USPC ..... 446/85, 104–105, 108–110, 120–121
See application file for complete search history.

(56) References Cited

U.S. PATENT DOCUMENTS

D301,260 S * 5/1989 McLaughlin ..... D21/500
5,676,251 A * 10/1997 Credle, Jr. ..... A63H 33/086 206/501
6,371,823 B1 * 4/2002 Stavran ..... B65D 81/361 446/128
9,480,931 B1 * 11/2016 Samo ..... A63H 33/086

* cited by examiner

*Primary Examiner* — Kien Nguyen

(57) ABSTRACT

A building brick base assembly includes a plate having a top side, a bottom side and a perimeter edge. The top side is planar and the plate has an opening extending therethrough. A plurality of male interconnection members is integral to and extends upwardly from the top side. A plurality of female interconnection members is integral to the bottom side of the plate. The male and female interconnection members are configured to releasably engage bricks from a building brick system. A panel has a perimeter edge and the panel is pivotally coupled to the plate adjacent to the opening. The panel is positionable in a closed position closing the opening or a deployed position exposing the opening.

16 Claims, 4 Drawing Sheets

BUILDING BRICK BASE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to building brick base devices and more particularly pertains to a new building brick base device for allowing movement of toys from one level to another on a structure formed by stackable bricks and intervening floor levels.

BRIEF SUMMARY OF THE INVENTION

An embodiment of the disclosure meets the needs presented above by generally comprising a plate having a top side, a bottom side and a perimeter edge. The top side is planar and the plate has an opening extending therethrough. A plurality of male interconnection members is integral to and extends upwardly from the top side. A plurality of female interconnection members is integral to the bottom side of the plate. The male and female interconnection members are configured to releasably engage bricks from a building brick system. A panel has a perimeter edge and the panel is pivotally coupled to the plate adjacent to the opening. The panel is positionable in a closed position closing the opening or a deployed position exposing the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
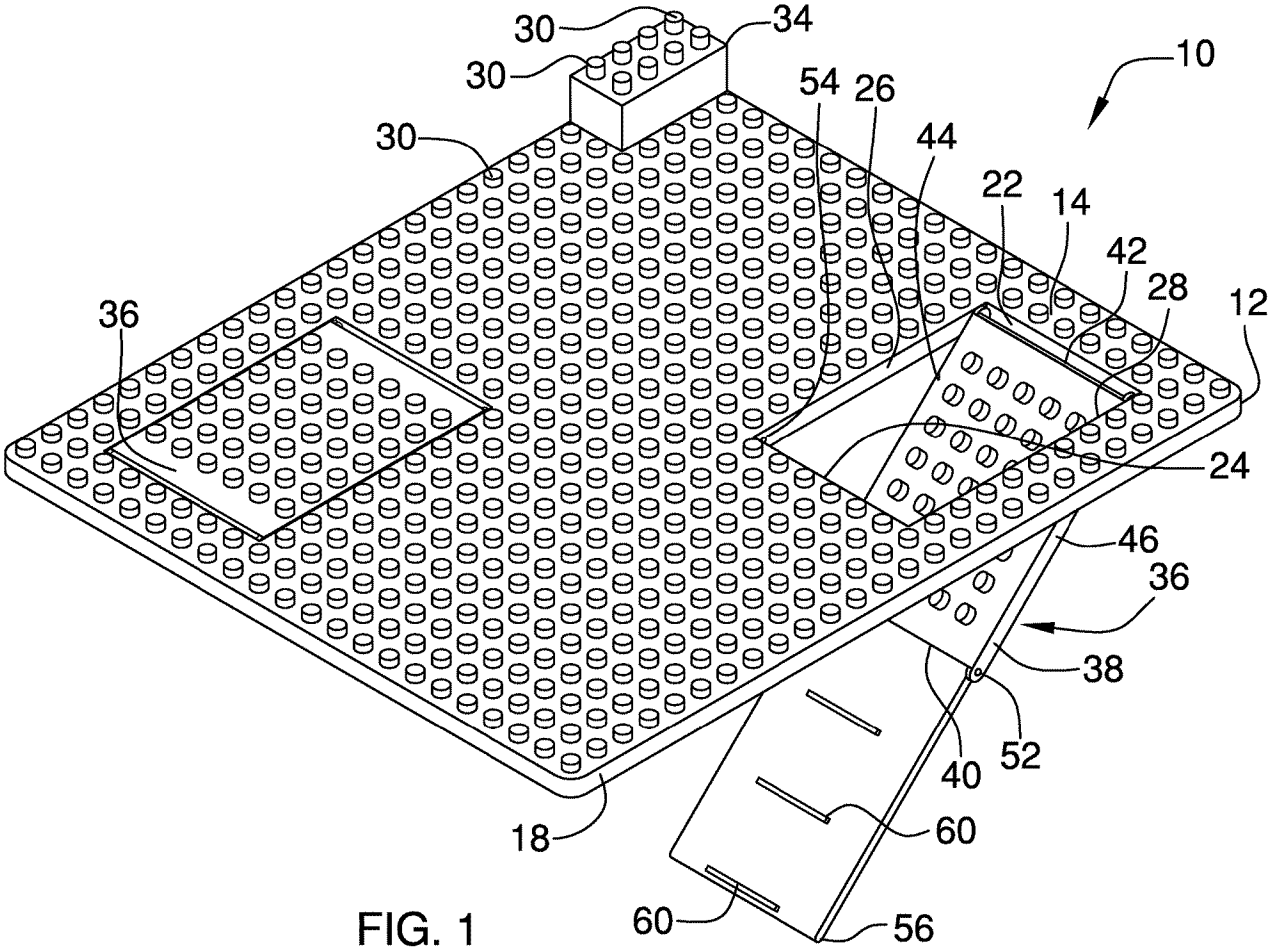
FIG. 1 is a top perspective view of a building brick base assembly according to an embodiment of the disclosure.
Figure 2:
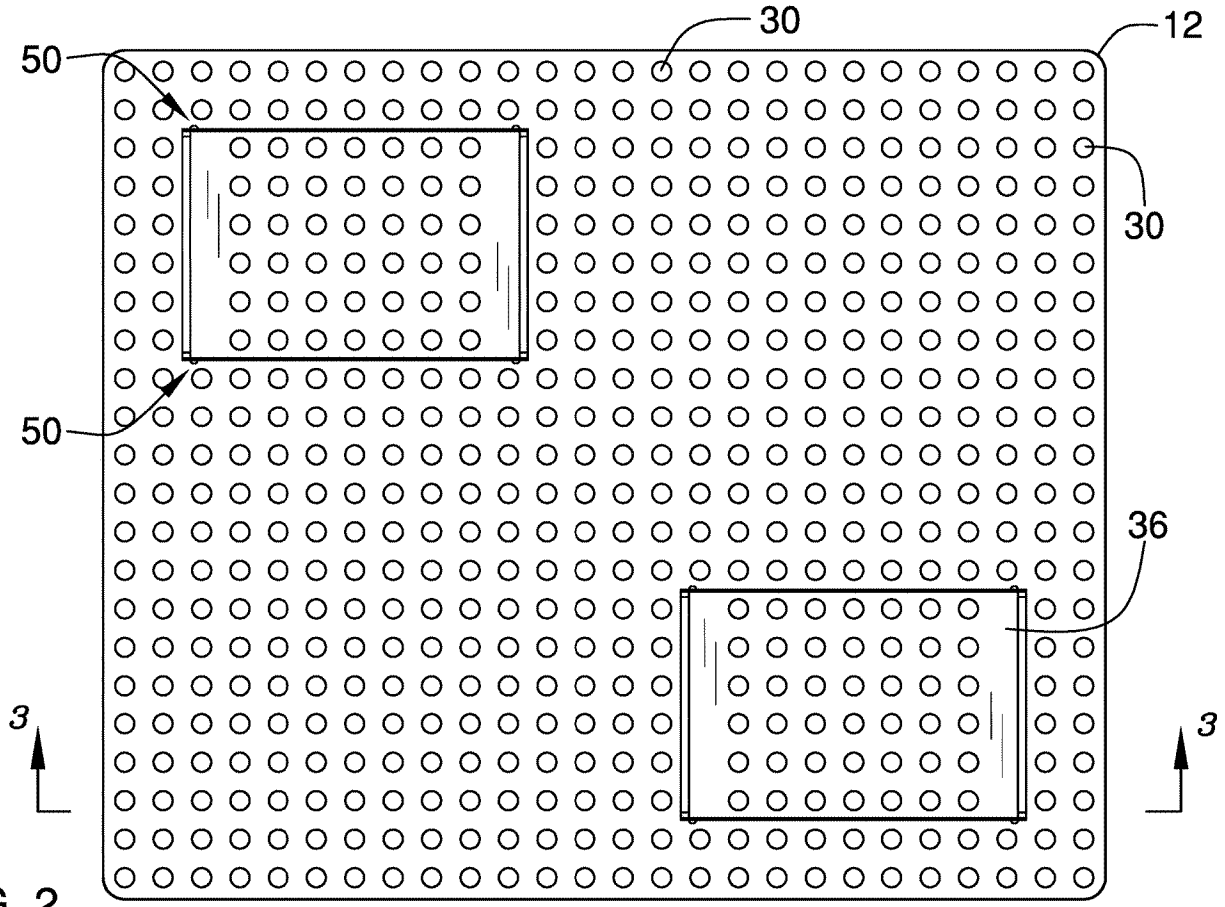
FIG. 2 is a top view of an embodiment of the disclosure.

With reference now to the drawings, and in particular to FIGS. 1 through 5 thereof, a new building brick base device embodying the principles and concepts of an embodiment of the disclosure and generally designated by the reference numeral 10 will be described.

As best illustrated in FIGS. 1 through 5, the building brick base assembly 10 generally comprises a plate 12 having a top side 14, a bottom side 16 and a perimeter edge 18. The top side 14 is planar and the plate 12 has an opening 20 extending therethrough, and in particular extending through the top 14 and bottom 16 sides. The opening 20 may have any shape but as shown in the Figures, the opening may particularly be rectangular shaped and have a first end edge 22, a second end edge 24, a first lateral edge 26 and a second lateral edge 28. The plate 12 has a length that is greater than 3.0 inches and a width is greater than 2.0 inches and more typically the plate 12 will have a length and width each being greater than 5.0 inches. As can be seen in the Figures, the plate 12 may have more than one opening 20.

A plurality of male interconnection members 30 is integral to and extends upwardly from the top side 14. A plurality of female interconnection members 32 is integral to the bottom side 16 of the plate 12. The male 30 and female 32 interconnection members are configured to releasably engage toy bricks 34 from a building brick system. Brick systems utilizing similar structures for usage with the plate 12 for frictionally coupling together toy bricks are ubiquitous in the toy arts and are found in multiple references such as U.S. Pat. No. 3,005,282. These toy bricks 32 may be found, for instance, being sold under the tradenames Lego and Duplo. Generally, the male interconnection member 30 includes one or more male protrusions that extend upwardly from an upper surface of the toy brick 34 and the top side 14 of the plate 12. The female interconnection member 32 includes one or more recesses for receiving the male interconnection member 30 that would be found on the toy bricks 34 and in the bottom side 16 of the plate 12. The recesses may be formed in any conventional manner.

A panel 36 is provided which has a perimeter edge 38 including a front edge 40, a rear edge 42, a first side edge 44 and a second side edge 46. The panel 36 is pivotally coupled to the plate 12 adjacent to the opening 20 and is positionable in a closed position closing the opening 20 or a deployed position exposing the opening 20. The panel 36 may be pivotable into a downward deployment extending downwardly from the plate 12 or into an upward deployment extending upwardly from the plate 12. As such, the panel 36 forms a ramp from one level to another when a child is building a vertical structure with assembly 10 including a plurality of plates 12 or similar articles that are vertically spaced from each other. A hinge pin 48 extends through the panel 36 and into the plate 12 to pivotally couple the panel 36 to the plate 12. The hinge pin 48 extends through the first 44 and second 46 side edges and is positioned adjacent to the rear edge 42. The panel 36 may have an upper surface comprising a plurality of male interconnection members 30.

A locking member 50 is positioned on the panel 36 and releasably locks the panel 36 in the closed positioned. The locking member 50 may include a detent 52 positioned on the perimeter edge 38 and extendable in a well 54 in a peripheral edge of the opening 20. A pair of locking members 50 may be utilized as is shown in the Figures. The detent 52 extends into and snappily engages the well 54 to retain the panel 36 in co-planar relationship with the plate 12.

Figure 3:
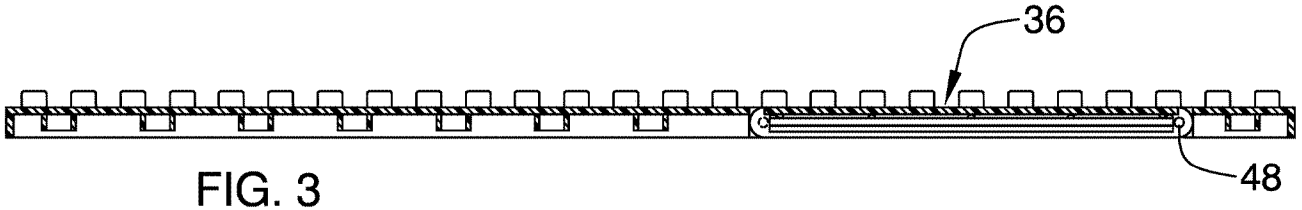
FIG. 3 is a cross-sectional view of an embodiment of the disclosure taken along line 3-3 of FIG. 2.
Figure 4:
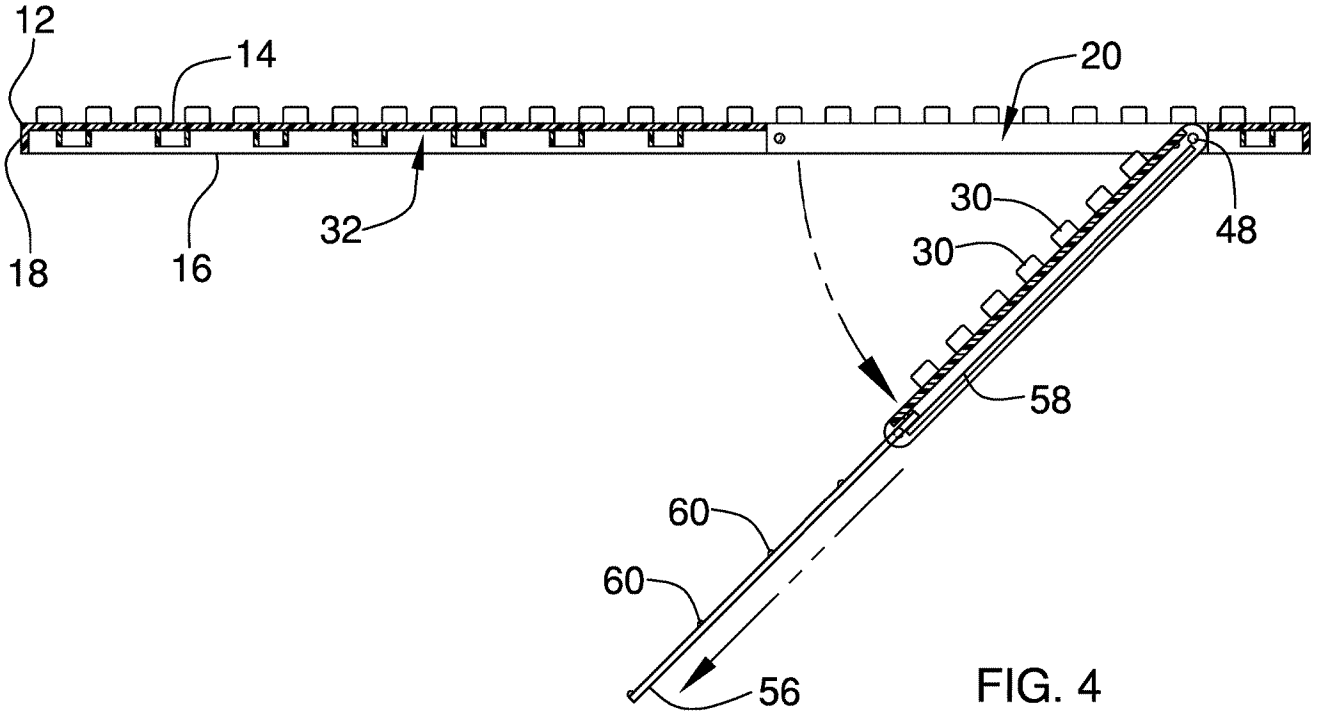
FIG. 4 is a cross-sectional view of an embodiment of the disclosure.
Figure 5:
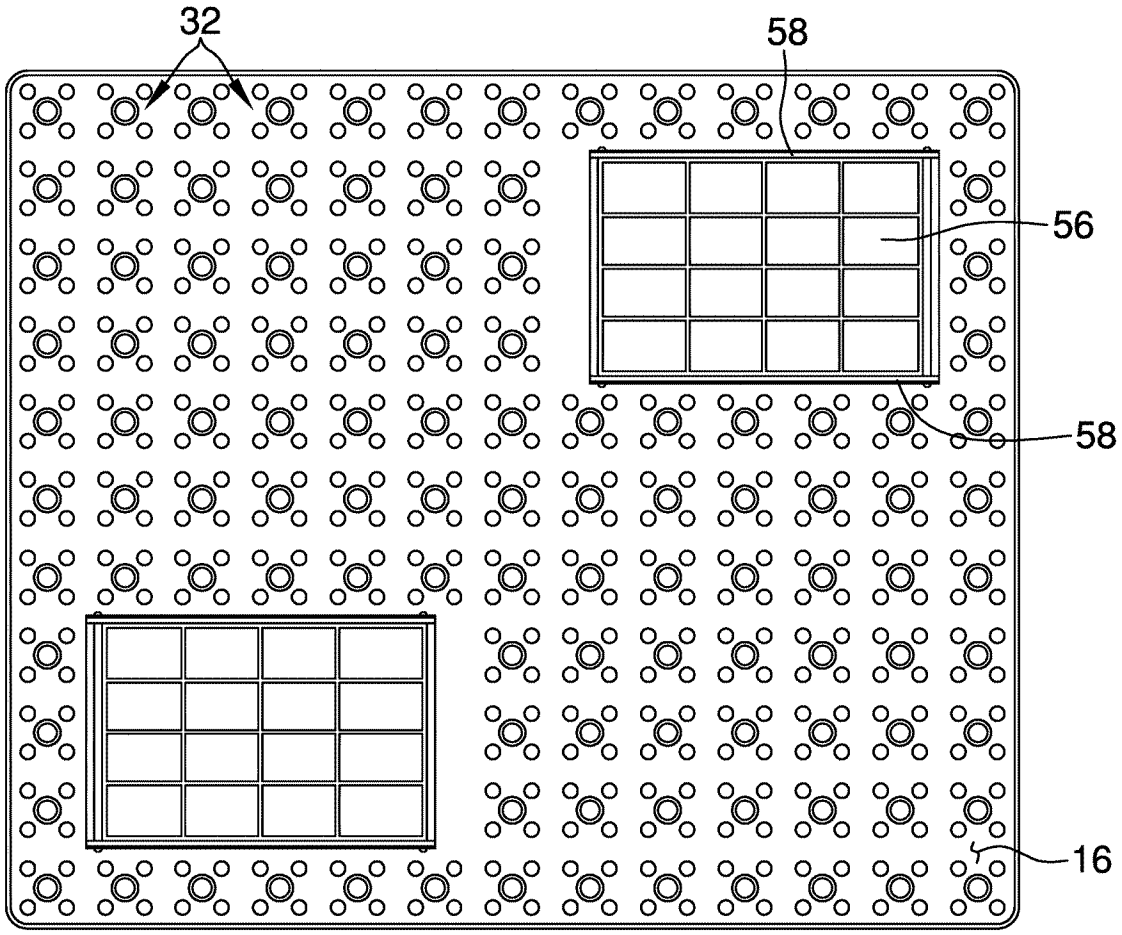
FIG. 5 is a bottom view of an embodiment of the disclosure.

An extension 56 is slidably mounted on the panel 36. The extension 56 is extendable outwardly from the front edge 40 to define a deployed position as shown in FIG. 1 or retained completely under the panel 36 to define a stored position as shown in FIG. 3. The extension 56 provides the user of the assembly the ability to span a greater distance between the plate 12 and next level positioned below or above the plate 12. The extension 56 may be positioned on of rails 58, positioned on the panel 36, and extending between the front 40 and rear edges 42. Alternatively, the extension 56 may be pivotally coupled to the panel so that it is pivoted to a stored position under or above the panel 36, or a deployed position extending away from the panel 36. The extension 56 may include integrally coupled ridges 60 for friction purposes and to help retain the extension 56 in the stored position by frictionally engaging the panel 36 as the extension 56 moves along the panel 36.

In use, the plate 12 is used as a conventional base for building brick systems using conventional interlocking securing structures. The plate 12 may be used for different "floors" of a structure being built with the assembly 10. The panel 36 may be pulled relative to the plate 12 to act as a ramp from one level to another of an overall structure.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A mounting brick base assembly configured to engage a building brick system, said assembly comprising:

a plate having a top side, a bottom side and a perimeter edge, said top side being planar, said plate having an opening extending therethrough;

a plurality of male interconnection members being integral to and extending upwardly from said top side, a plurality of female interconnection members being integral to said bottom side of said plate, said male and female interconnection members being configured to releasably engage bricks from a building brick system; and a panel having a perimeter edge, said panel being pivotally coupled to said plate adjacent to said opening, said panel being positionable in a closed position closing said opening or a deployed position exposing said opening, said panel having an upper surface comprising a plurality of male interconnection members.

2. The mounting brick base assembly according to claim 1, wherein said opening has a first end edge, a second end edge, a first lateral edge and a second lateral edge.

3. The mounting brick base assembly according to claim 2, wherein said perimeter edge includes a front edge, a rear edge, a first side edge and a second side edge.

4. The mounting brick base assembly according to claim 3, wherein a hinge pin extends through said panel and into said plate to pivotally couple said panel to said plate.

5. The mounting brick base assembly according to claim 4, wherein said hinge pin extends through said first and second side edges and being positioned adjacent to said rear edge.

6. The mounting brick base assembly according to claim 3, further including an extension being slidably mounted on said panel.

7. The mounting brick base assembly according to claim 6, wherein said extension is extendable outwardly from said front edge to define a deployed position or retained completely under said panel to define a stored position.

8. The mounting brick base assembly according to claim 1, wherein said plate has a length being greater than 3.0 inches and a width being greater than 2.0 inches.

9. The mounting brick base assembly according to claim 1, wherein said panel is pivotable into a downward deployment extending downwardly from said plate or into an upward deployment extending upwardly from said plate.

10. The mounting brick base assembly according to claim 1, wherein a hinge pin extends through said panel and into said plate to pivotally couple said panel to said plate.

11. The mounting brick base assembly according to claim 1, further including a locking member being positioned on said panel and releasably locking said panel in said closed positioned.

12. The mounting brick base assembly according to claim 11, wherein said locking member includes a detent positioned on said perimeter edge and extendable in a well in a peripheral edge of said opening.

13. The mounting brick base assembly according to claim 1, further including an extension being slidably mounted on said panel.

14. A mounting brick base assembly configured to engage a building brick system, said assembly comprising:

a plate having a top side, a bottom side and a perimeter edge, said top side being planar, said plate having an opening extending therethrough, said opening having a first end edge, a second end edge, a first lateral edge and a second lateral edge, said plate having a length being greater than 3.0 inches and a width being greater than 2.0 inches;

a plurality of male interconnection members being integral to and extending upwardly from said top side, a plurality of female interconnection members being integral to said bottom side of said plate, said male and female interconnection members being configured to releasably engage bricks from a building brick system;

a panel having a perimeter edge, said perimeter edge including a front edge, a rear edge, a first side edge and a second side edge, said panel being pivotally coupled to said plate adjacent to said opening, said panel being positionable in a closed position closing said opening or a deployed position exposing said opening, said panel being pivotable into a downward deployment extending downwardly from said plate or into an upward deployment extending upwardly from said plate, a hinge pin extending through said panel and into said plate to pivotally couple said panel to said plate, said hinge pin extending through said first and second side edges and being positioned adjacent to said rear edge, said panel having an upper surface comprising a plurality of male interconnection members;

a locking member being positioned on said panel and releasably locking said panel in said closed positioned, said locking member including a detent positioned on said perimeter edge and extendable in a well in a peripheral edge of said opening; and an extension being slidably mounted on said panel, said extension be extendable outwardly from said front edge to define a deployed position or retained completely under said panel to define a stored position.

15. A mounting brick base assembly configured to engage a building brick system, said assembly comprising:

a plate having a top side, a bottom side and a perimeter edge, said top side being planar, said plate having an opening extending therethrough;

a plurality of male interconnection members being integral to and extending upwardly from said top side, a plurality of female interconnection members being integral to said bottom side of said plate, said male and female interconnection members being configured to releasably engage bricks from a building brick system; and a panel having a perimeter edge, said panel being pivotally coupled to said plate adjacent to said opening, said panel being positionable in a closed position closing said opening or a deployed position exposing said opening; and an extension being slidably mounted on said panel.

16. The mounting brick base assembly according to claim 15, wherein said extension is extendable outwardly from said front edge to define a deployed position or retained completely under said panel to define a stored position.

* * * * *